US009308549B1

(12) United States Patent
Kern

(10) Patent No.: US 9,308,549 B1
(45) Date of Patent: Apr. 12, 2016

(54) PAINT BRUSH AND ROLLER SYSTEM

(71) Applicant: John Kern, Helena, OH (US)

(72) Inventor: John Kern, Helena, OH (US)

( * ) Notice: Subject to any disclaimer, the term of this patent is extended or adjusted under 35 U.S.C. 154(b) by 0 days.

(21) Appl. No.: 14/166,216

(22) Filed: Jan. 28, 2014

Related U.S. Application Data

(60) Provisional application No. 61/757,858, filed on Jan. 29, 2013.

(51) Int. Cl.
*B05C 17/02* (2006.01)
*A46B 7/04* (2006.01)

(52) U.S. Cl.
CPC ..... *B05C 17/0222* (2013.01); *A46B 7/044* (2013.01); *A46B 2200/202* (2013.01); *B05C 17/02* (2013.01); *B05C 17/0205* (2013.01)

(58) Field of Classification Search
CPC ..... B05C 17/02; B05C 17/0205; A46B 7/04; A46B 7/044; A46B 5/0095; A46B 2200/202; A46B 2200/205
USPC ..... 15/176.1, 176.4–176.6, 230.11, 172
See application file for complete search history.

(56) References Cited

U.S. PATENT DOCUMENTS

| | | | | |
|---|---|---|---|---|
| 5,249,330 | A * | 10/1993 | Janssen | 15/230.11 |
| 6,145,151 | A * | 11/2000 | Herron | A46B 5/02 15/143.1 |
| 6,173,471 | B1 * | 1/2001 | Yau | 15/244.1 |
| 6,348,235 | B1 * | 2/2002 | Cavill et al. | 427/280 |
| 6,742,213 | B1 * | 6/2004 | Vaes | A46B 3/12 15/143.1 |
| 2002/0138935 | A1 * | 10/2002 | Lanz | 15/230.11 |

FOREIGN PATENT DOCUMENTS

WO WO 2013/098266 A2 * 7/2013 ..... A45D 19/0008

* cited by examiner

*Primary Examiner* — Laura C Guidotti
(74) *Attorney, Agent, or Firm* — Jerry Semer

(57) ABSTRACT

The articles of manufacture make up a paint brush and roller system. The system is comprised of two different handles that takes different brushes and rollers. One handle is a straight handle similar to paintbrush handles on the market except it is fatter. The second handle is a handle in which the paint brush bristles are perpendicular to the individuals grip. The individual can paint without moving one's wrist. The system comes with a set of interchangeable brushes and rollers. The handles have at their top a dovetail groove. The brush heads have at their bottom a dovetail. The brush heads' dovetail fits within the handle's dovetail groove and is held in place by friction. The roller has a dove tail that fits within the handles' dovetail groove.

7 Claims, 19 Drawing Sheets

PAINT BRUSH AND ROLLER SYSTEM

FIELD OF INVENTION

This invention relates to the field of devices for paint application and more particularly to the field of paint brushes handles with interchangeable brush heads and rollers.

BACKGROUND OF THE INVENTION

In order to use a paint brush one has to move his wrist as he moves up and down or from side to side with the brush. If a person is employed as a painter he has to make this motion day in and day out. This will ultimately lead to the painter getting a repetitive stress injury or carpal tunnel syndrome and painting will cause him a great deal of pain.

Also, for older painters who have arthritis within their wrists, painting is painful. The inventor has designed a brush will greatly reduce these problems. Thus, the first objective of this invention is to create a brush which an individual can use without the normal up and down movement or side to side movement of the wrist. The feature that enables the inventor's brush to be used without movement of the wrist is that the inventor has moved the handle so that the handle would be ninety degrees or perpendicular to the brush head. This also enables the painter to grab the brush in a normal grip. He can now use the brush without movement of his wrist. The applicant has further made the brush handle slightly curved and shaped so that an individual can hold the brush in a normal grip. Another problem of the brushes presently out on the market is that the brush head wears out far earlier than the handle of the brush. The brush head can wear out for several reasons. The first being that the brush was not properly cared for thus the paint, varnish or shellac has dried within the brush making it unusable. Brush heads also wear out from normal use. In both of these cases the brush head will wear out long before the handle wears out.

Thus, one of the objectives of this invention is to create a method of removing a brush head from the handle and replacing it with another. Applicant has developed a method for interchangeable brush heads so if the first one wears the brush head can be replaced with another. This also enables the individual to place brush heads of different sizes on the brush. Thus, one handle can be used for a one inch brush as well as a three inch brush head. Further, being able to take the brush head off the handle enables the individual to more easily clean the brush head. Due to the smaller size brush head it allows for a smaller storage area for the brush. It also makes the storage must easier. The brush heads are small enough that they can easily be placed in a small plastic bag.

The handle can also be used for a roller. Thus, painter can place either the brush head or a roller on the handle. The perpendicular handle enables the painter to use the roller with a different motion then the roller presently out on the market. It has been applicant's experience that painters who use the roller with the perpendicular handle preferred it to a regular roller with a handle.

SUMMARY OF THE INVENTION

Applicant has developed a whole new painting system. The painting system centers around two different handles. The first handle is a straight handle and is similar to the handles of paint brushes on the market. This handle differs from paint brushes on the market by the fact that it will hold interchangeable brushes. This product is a paint brush with interchangeable paintbrush heads. The product has two components, the straight handle and the different size paintbrush heads. The straight handle has a dove tail groove on its top and the paint brush head has a dove tail on its bottom. The dovetail of the paint brush head fits within the dovetail groove of the straight handle. The friction between the dovetail groove and the dovetail holds the paint brush head upon the straight handle solidly. Not only are the heads interchangeable but you can place more than one paintbrush head on the straight handle. Thus if the individual did not have a 3 inch paintbrush but had 1 inch brush heads and 2 inch brush heads he could place the 1 inch brush head and a 2 inch brush head on his straight handle and form a 3 inch brush head. The applicant has also fattened the handle for better grip. The second handle, the perpendicular handle, is entirely different from regular paintbrush handles. The object of this second handle is to enable an individual to paint without bending one's wrist. In this handle the paint brush bristles are perpendicular to one's grip. The painting system for perpendicular handle has two components as the straight handle system, the perpendicular handle and the brush head. The brush head for the perpendicular handles are exactly the same as the brush heads for the straight handle and these brush heads can be interchangeable upon either handle. As in the previous embodiment the brush head has a dove tail on its bottom and the handle has a dove tail groove on its side. The dovetail on the bottom of the brush head fits within the dovetail groove on the perpendicular handle and the brush head is held in place by friction within the dovetail groove. From the dovetail groove the perpendicular handle begins to extend downward. This handle, however extends downward from the side of the dovetail for only a short distance. It then extends parallel to the dovetail groove section. This creates an open area under the dove tail groove section for the individual to grip the handle. This handle is also fatter than the normal handle for easier grip.

The roller is similar to the rollers presently on the market. However, the handle has been removed and replaced with a dovetail. This dove tail fits within the dovetail groove on the perpendicular handle. At the very bottom of the dovetail is a threaded extension. The threaded extension is designed to allow a pole with threads on its top to be threaded within the threaded extension to extend the handle of the roller for painting in high areas and ceilings.

DETAILED DESCRIPTION OF THE PREFERRED EMBODIMENT

Figure 1:
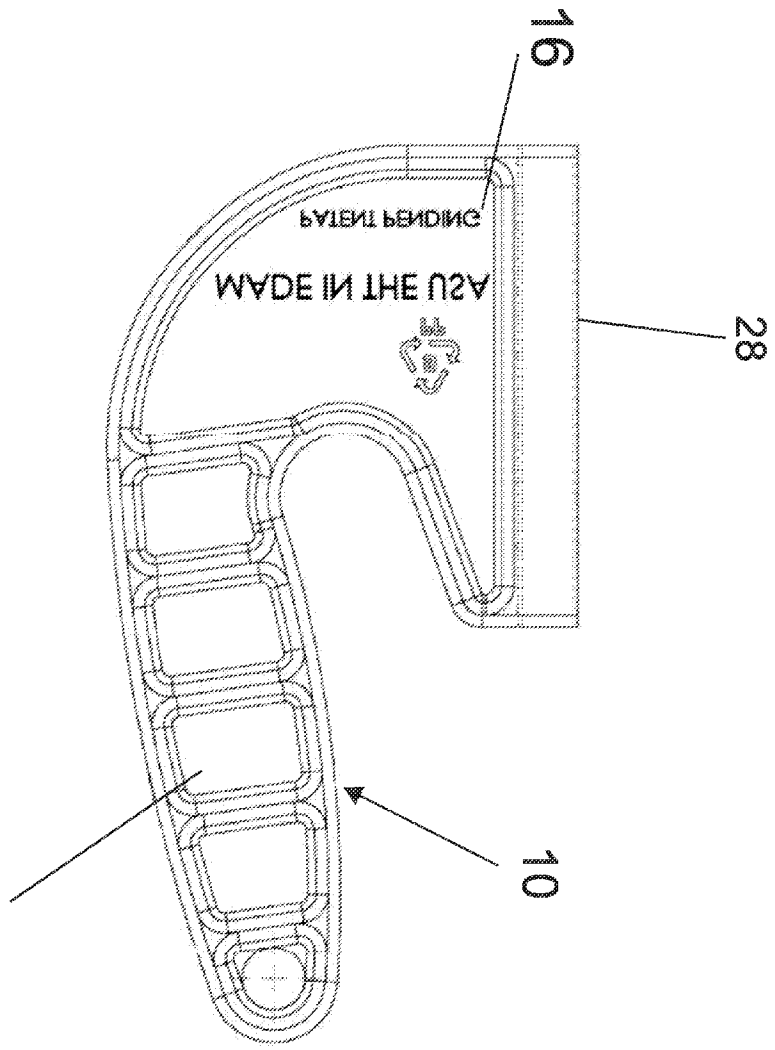
FIG. 1 is a front view of the perpendicular handle.
Figure 2:
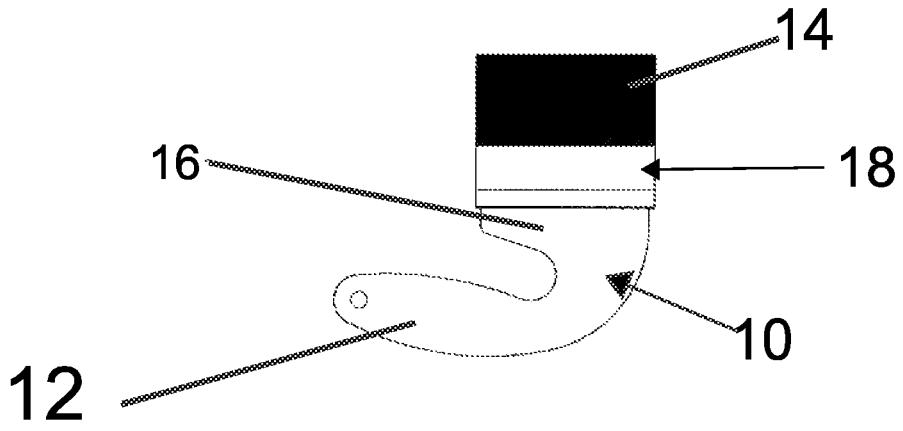
FIG. 2 is a from view of the perpendicular handle with the brush head attached.
Figure 3:
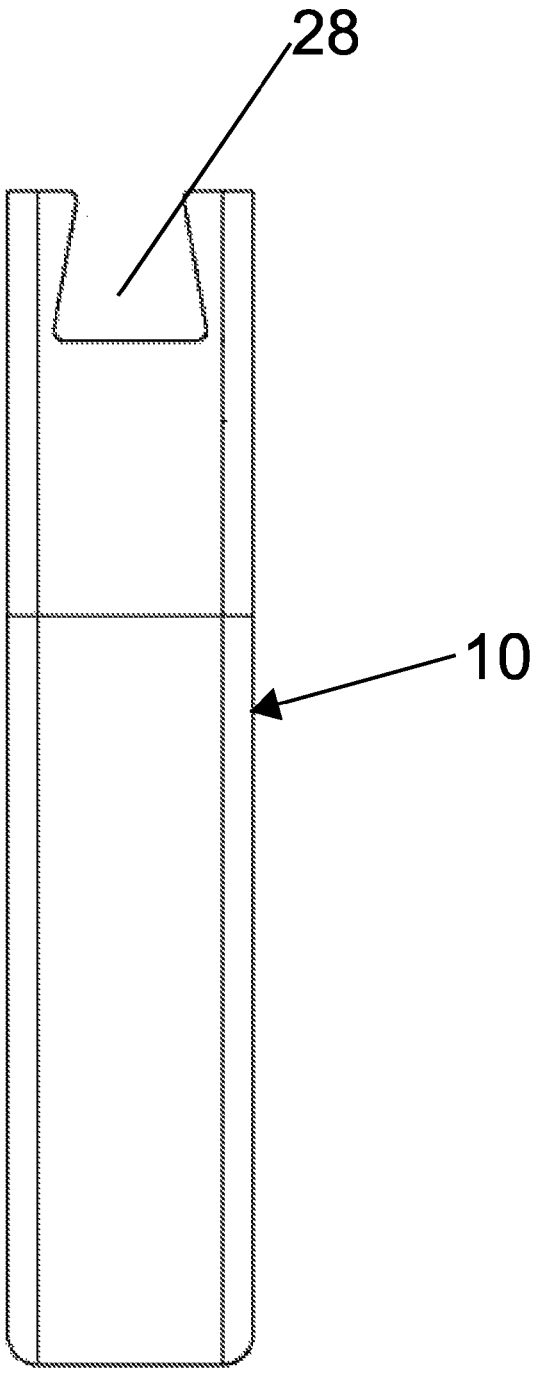
FIG. 3 is the side view of the perpendicular handle.
Figure 4:
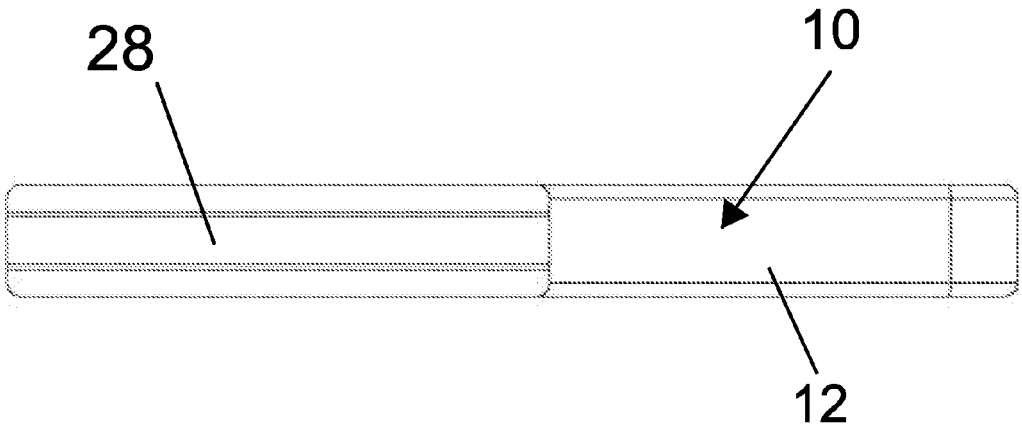
FIG. 4 is a top view of the perpendicular handle.
Figure 4A:
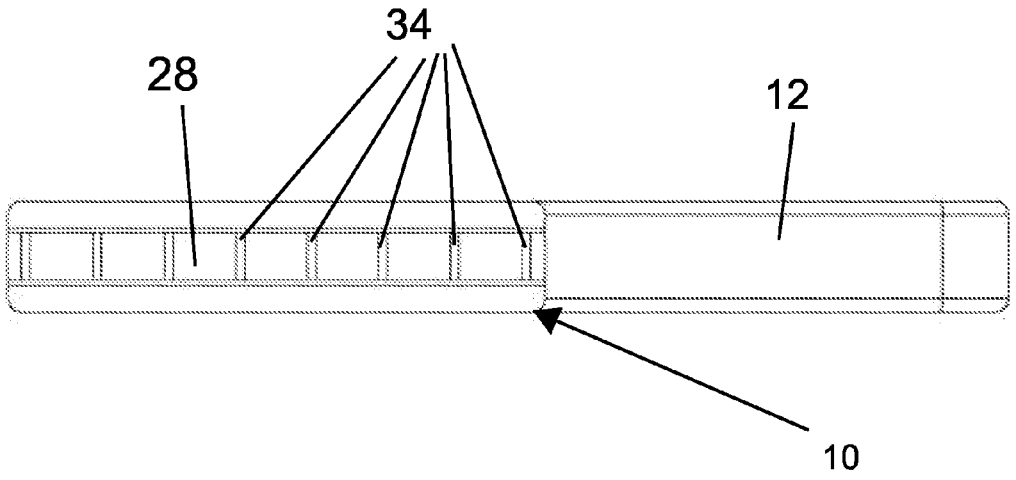
FIG. 4A is a top view of another embodiment of the perpendicular handle.

FIG. 1 is a front view of the perpendicular handle 10. FIG. 2 is a front view of the perpendicular handle 10 with the brush head 18 attached. FIG. 3 shows the side view of the perpendicular handle 10. FIGS. 4 and 4A is the top view of perpendicular handle 10. At the top of the perpendicular handle 10 is a dovetail groove 28. The dovetail groove 28 runs along the length of the top of the perpendicular handle 10 as shown in FIGS. 4 and 4A. The perpendicular handle 10 extends downward from the dovetail groove 28. The perpendicular handle 10 extends downward from the side of a dovetail groove section 16 for a short distance. Than the bottom section 12 of the perpendicular handle 10 extends nearly parallel to the dovetail groove 28. The bottom section 12 leaves an open area between it and the dove tail grove section 16. The bottom section 12 extends past the end of the dovetail grove 28 and nearly parallel to the dovetail grove 28.

To grip the perpendicular handle 10 one places his fingers between the bottom section 12 of the perpendicular handle 10 and the dovetail groove section 16 and then wraps one's fingers around the bottom section 12 of the perpendicular handle 10. The bottom section 12 of the perpendicular handle 10 is larger than a normal paintbrush handle. This enables the individual using the perpendicular handle 10 to grip the perpendicular handle 10 more easily. As one can see from FIG. 2 the bottom section 12 of the perpendicular handle 10 is not quite perpendicular to the bristles 14 of brush section 18. In the preferred embodiment the angle is slightly less than 90°. The bottom section 12 of the perpendicular handle 10 can vary from being perpendicular with the bristles 14 of brush section 18 by as much as 45°. However applicant has found that painters prefer the angle of bottom section 12 of perpendicular handle 10 being slightly less than 90° from the alignment of the bristles 14.

FIG. 3 is the side view of the perpendicular handle 10. FIG. 3 shows the shape of the dove tail groove 28. The dovetail groove 28 is a dovetail with its sides slanting outward.

Figures 5, 5A:
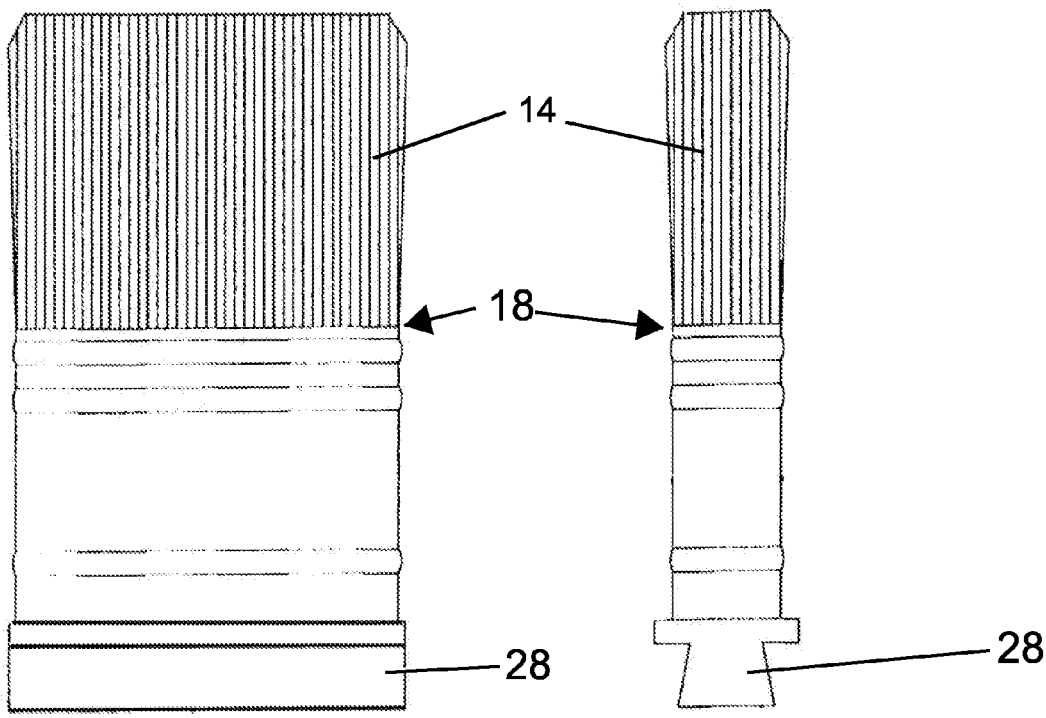
FIG. 5 is a side view of the brush head.
FIG. 5A is an end view of the brush head.

FIG. 5 is a side view of the brush head 18. FIG. 5A is an end view of the brush head 18. The end view FIG. 5A shows that the bottom of the brush head 18 has a dove tail extension 30. This dove tail extension 30 fits within the dove tail groove 28 at the top of the perpendicular handle 10. Dovetail extension 30 and dovetail groove 28 are designed to fit together with a friction fit. Dovetail extension 30 and dovetail groove 28 are designed with a friction fit so that the brush head 18 will not move on perpendicular handle 10 without substantial force. In the preferred embodiment the perpendicular handle 10 and the dovetail extension 30 of brush head 18 are made of plastic. The plastic is picked from a group of plastics that create a secure friction fit.

Figures 5B, 5C:
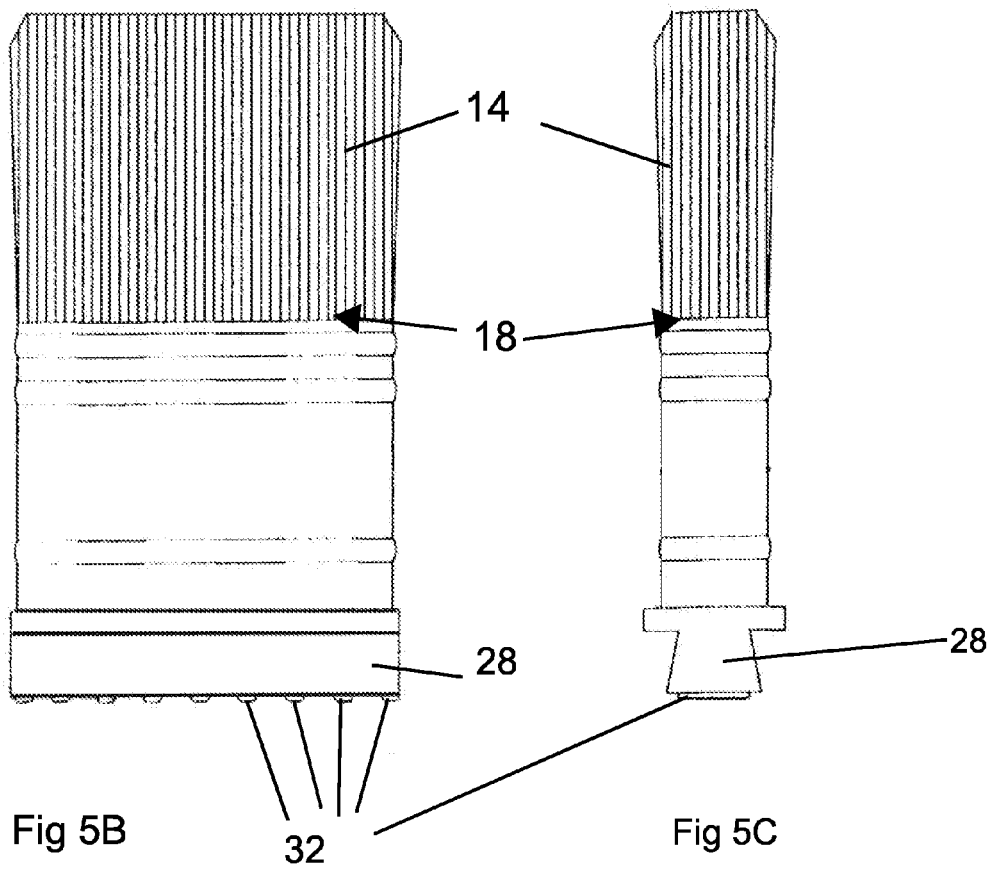
FIG. 5B is a side view of another embodiment of the brush head.
FIG. 5C is an end view of another embodiment of the brush head.
Figure 6A:
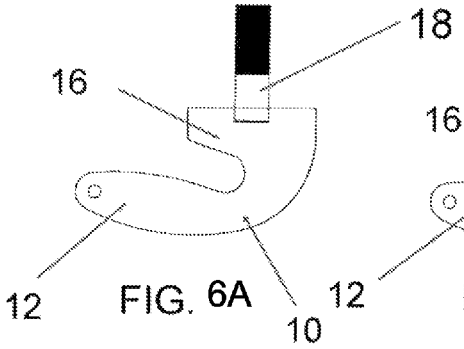
FIG. 6A is a side view of perpendicular handle with a different size of brush head form FIG. 2.
Figure 6B:
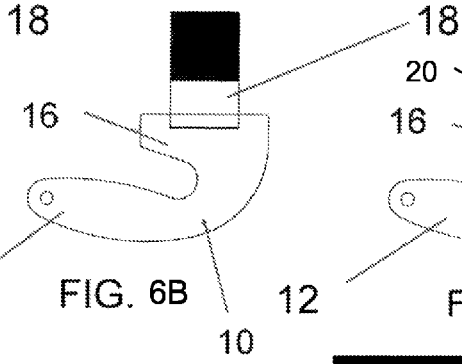
FIG. 6B is a side view of the perpendicular handle with a different size brush head from FIGS. 2 and 6A.
Figure 6C:
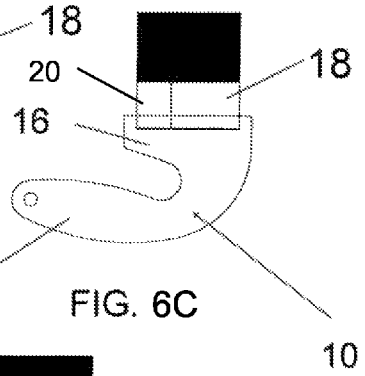
FIG. 6C is a side view of the perpendicular handle with two brush heads of differing sizes.
Figure 6D:
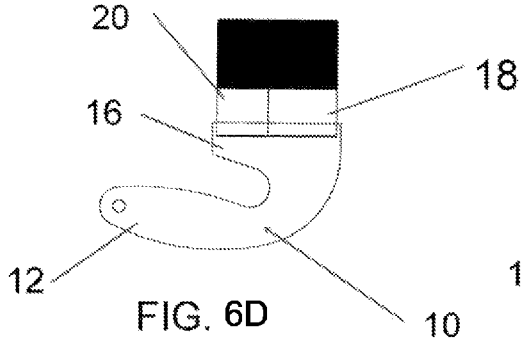
FIG. 6D is a side view of the perpendicular handle two brush heads different form FIG. 6C of differing sizes.
Figure 6E:
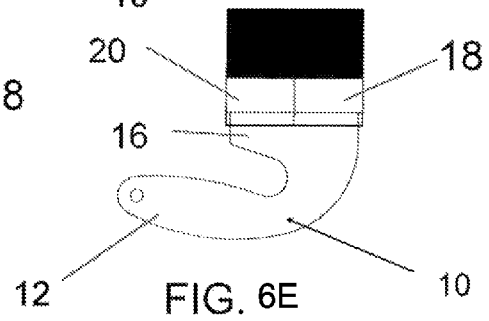
FIG. 6E is a side view of the perpendicular handle with two brush heads of the same size.

Another embodiment of the perpendicular handle 10 and the brush head 18 are shown in FIGS. 5B and 5C. In this embodiment perpendicular handle 10 and brush head 18 are made exactly as the previous embodiment except that on the dovetail extension 30 on brush head 18 a set of bumps 32 are placed. These bumps 32 correspond to a set of grooves 34 placed on the bottom of the dove tail groove 28 of perpendicular handle 10 shown in FIG. 4A. When the dovetail extension 30 is placed within dovetail groove 28 the bumps 32 on the dovetail extension 30 fit within the grooves 34 on the dovetail groove 28.

FIGS. 6A, 6B, 6C, 6D, and 6E show other embodiments of the invention. In these embodiments the perpendicular handle 10 holds many different sizes of brush heads 18 and 20. Also as pointed out by FIGS. 6C, 6D, and 6E the perpendicular handle 10 can hold more than one brush head 18 and 20. The brush heads 18 and 20 are interchangeable. Brush head 18 or 20 in FIGS. 6A, 6B, 6C, 6D, and 6E can be removed from the perpendicular handle 10 and be replaced with another brush head 18 or 20. In this embodiment there are two brush heads 18 and 20 in FIGS. 6C, 6D, and 6E placed upon the perpendicular handle 10. In the preferred embodiment perpendicular handle 10 is approximately 3 to 4 inches wide. It can hold two or more brush heads 18 and 20. The brush heads 18 or 20 can vary in width.

Figure 7:
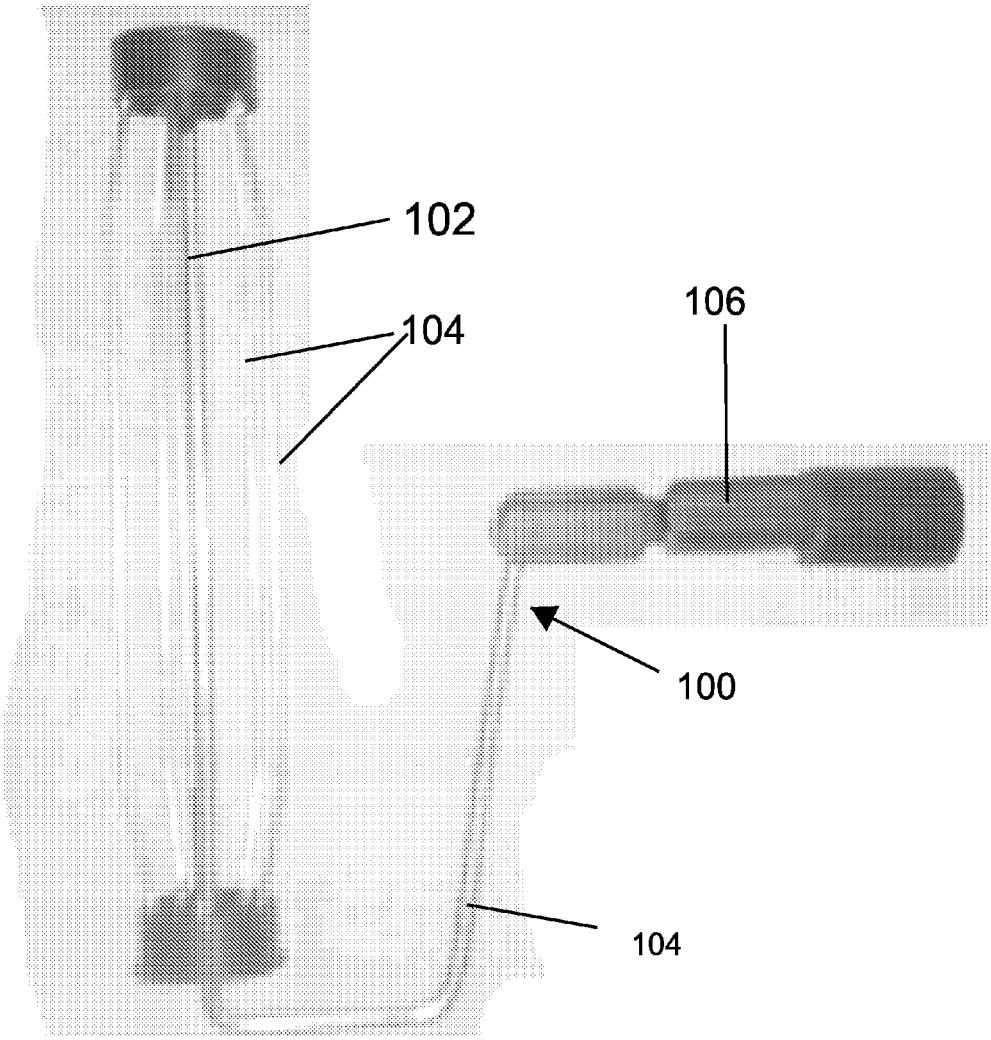
FIG. 7 is a front view of the attachment roller.

FIG. 7 shows an attachment roller 100 for perpendicular handle 10. The attachment roller 100 looks similar to a roller that is presently on the market. As the roller presently on the market the attachment roller 100 has at its top a cage 1102 on which the roller's 100 painting surface is placed. The cage 102 is designed to rotate around a cylindrical bar 104. The cylindrical bar 104 passes through the center of the cage 102 and upon exiting the cage bends downward. The cylindrical bar 104 then bends back towards the handle attachment 106. In rollers presently on the market the cylindrical bar would then bend back towards a straight handle. In the present invention the cylindrical bar 102 bends back towards the handle attachment 106. In other words applicants invention differs from the roller presently on the market in that the handle of the roller presently a on the market has been replaced by the handle attachment 106 of applicant's patent.

Figure 8:
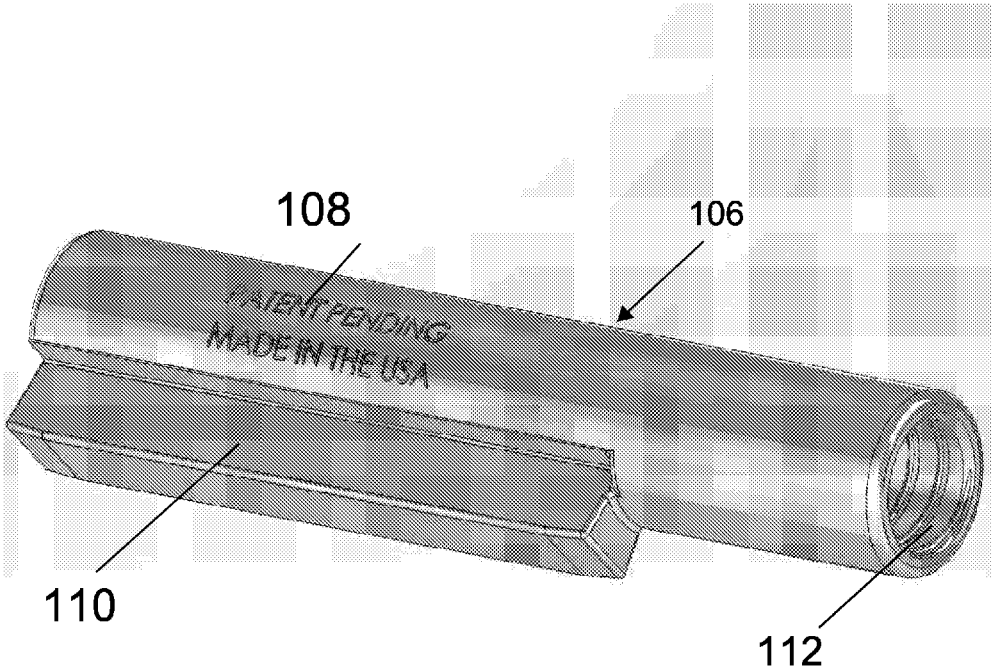
FIG. 8 is a side view of the handle attachment.

The handle attachment 106 is shown in FIG. 8. The handle attachment 106 is comprised of the attachment block 108 that attaches the handle attachment 106 to the cylindrical bar 102 and a dove tail extension 110. Extending from the side of the handle attachment block 108 is the dovetail extension 110. To use the attachment roller 100 the dovetail extension 110 of the handle attachment 106 is placed within the dove tail groove 28 of the perpendicular handle 10.

At the bottom of the handle attachment 106 a threaded extension 112 is attached. This threaded extension 112 is threaded and is designed to allow a pole to be threaded within. When the pole is threaded within the threaded extension 112 the roller 1100 can be used to paint ceilings and high areas.

Figure 9:
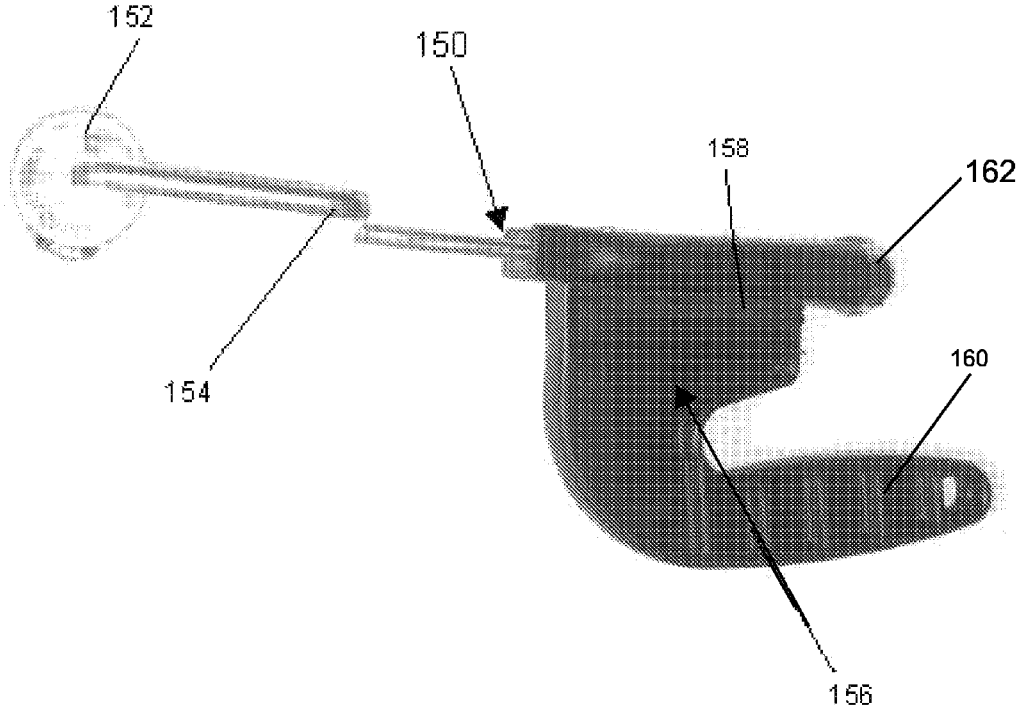
FIG. 9 is a side view of a roller with the perpendicular handle 156 permanently attached.

FIG. 9 shows another embodiment of the invention. FIG. 9 looks exactly as FIG. 7 with the perpendicular handle 10 attached except the handle in FIG. 9 is not detachable. In FIG. 9 the roller 150 is exactly the same as the roller in FIG. 7. As in the previous embodiment the roller 150 has at its top a cage 152 on which the roller's 150 paint surface is placed. The cage 152 is designed to rotate around a cylindrical bar 154. The cylindrical bar 154 passes through the center of the cage 152 and upon exiting the cage turns downward. The cylindrical bar 154 then bends back towards the perpendicular roller handle 156. Unlike the previous embodiment the cylindrical bar 154 does not attach to the handle attachment 106, it attaches directly to the perpendicular roller handle 156. Perpendicular roller handle 156 is almost exactly like perpendicular handle 10. The only difference is that the cylindrical bar 154 attaches permanently to perpendicular roller handle 156 on the side of perpendicular handle 156. In perpendicular roller handle 156 the dovetail groove section 16 of perpendicular handle 10 has been replaced by the attaching cylindrical bar section 158. On the side of perpendicular roller handle 156 in place of the dovetail groove 28 of perpendicular handle 10 is the attaching bar section 158. The perpendicular roller handle 156 extends away from the attaching bar section 158. The perpendicular roller handle 156 extends away from the attaching bar section 158 for a short distance. Then the perpendicular roller handle's 156 bottom section 160 extends parallel to the attaching bar section 158. To use the roller one grips the bottom section 160 of the perpendicular roller handle 156 by placing one's fingers between the bottom section 160 of the perpendicular handle 156 and the attaching bar section 158. This enables the individual using the perpendicular roller handle 156 to grip the perpendicular roller handle 156 more easily.

Attaching to the bottom of the attaching cylindrical bar section 158 is a threaded extension 162. This threaded extension 162 is threaded and is designed to allow a pole to be threaded within. When the pole is threaded within the threaded extension 162 the roller 150 can be used to paint ceilings and high areas.

Applicant has found that painters prefer his perpendicular roller handle to the rollers that are now out on the market. Many have told him that it places the roller in an easier position to paint a wall.

Figures 10, 10A, 10B, 10C, 10D:
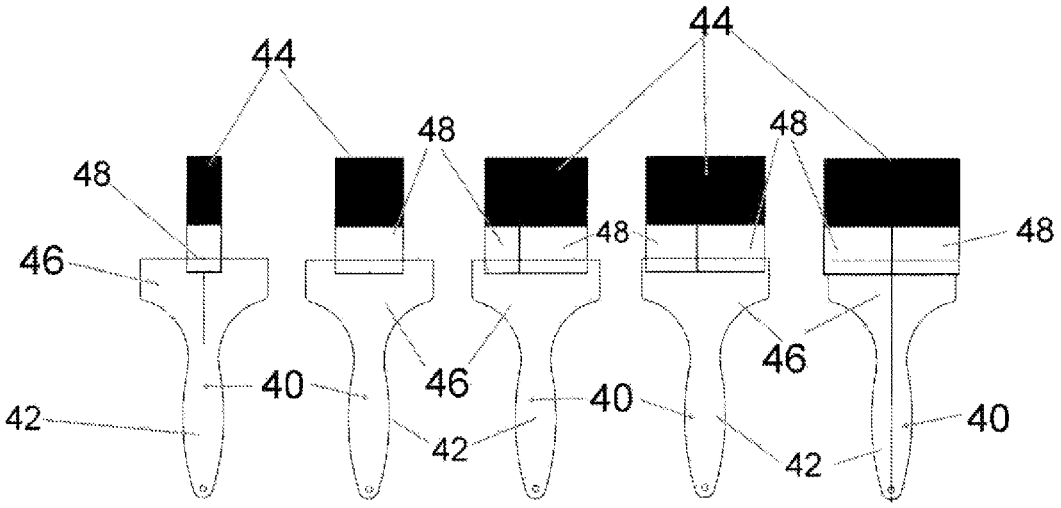
FIG. 10 is a side view of another embodiment of the invention.
FIG. 10A is a side view of another embodiment of the invention with a different size of brush head.
FIG. 10B is a side view of another embodiment of the invention with two brush heads of differing sizes.
FIG. 10C is a side view of another embodiment of the invention with two brush heads of differing sizes whose size are different from FIG. 10B.
FIG. 10D is a side view of another embodiment of the invention with two brush heads of the same size.
Figure 10E:
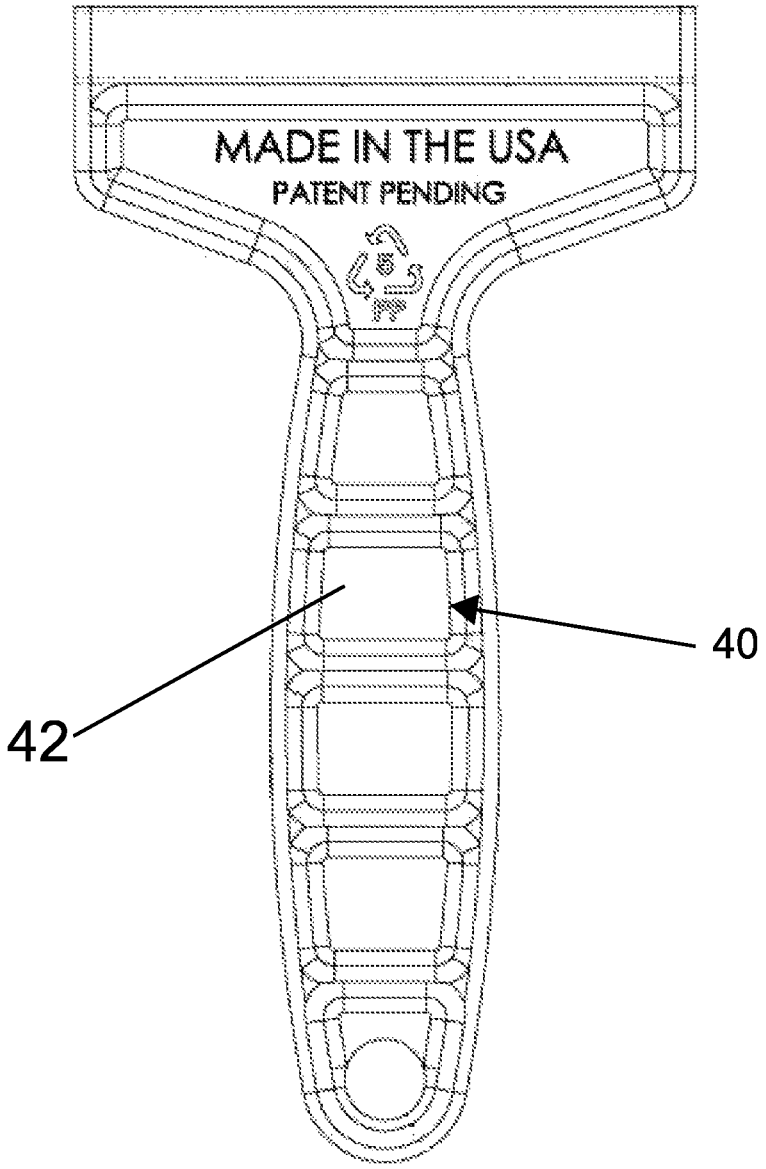
FIG. 10E is a side view of straight handle.

FIGS. 10, 10A, 10B, 10C, 10D, and 10E, show another embodiment of the invention. In FIGS. 10, 10A, 10B, 10C, 10D, and 10E, the straight handle 40 looks very similar to the paint brushes now on the market. FIG. 10E shows the front view of the straight handle 40. FIG. 10E show the straight handle 40 griping portion 42 is larger than a normal paint brush handle. FIG. 10 shows the griping portion 42 of the straight handle is in line with the strands 44 of the brush head 48. Straight handle 40 and a brush head 48 make up the paint brush. Within straight handle 40 one or more brush heads 48 that can be placed. In FIGS. 10, 10A, 10B, 10C, and 10D the brush head 48 is interchangeable with other brush heads 48. In this embodiment the straight handle 40 and the brush head 48 attach together just as in the previous embodiment. The brush heads 48 for this embodiment are designed similarly to the brush heads 18 for the previous embodiment. Brush heads 18 and 48 could be interchangeable. The width of the straight handle 42 can be made large enough so that more than one brush head could actually be placed on the straight handle 42. Thus, an individual could use, say two, two inch brush heads 48 if the straight handle 42 width was four inches, or he could use one four inch brush head 48.

Figure 12:
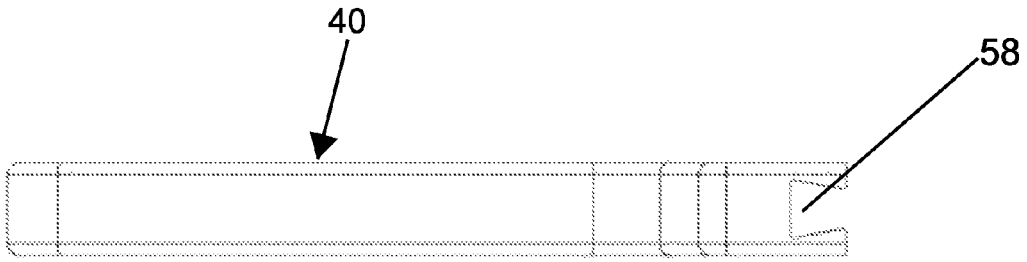
FIG. 12 is a side view of the straight handle.

The top portion 46 of straight handle 40 contains a dove tail grove 58. The shape of the dove tail groove 58 can be easily seen in FIG. 12, a side view of the straight handle 40. The sides of the dove tail groove 58 are slanted outward. This dove tail groove 58 is designed to allow the paint brush head 48 shown in FIGS. 13 and 13A to fit within.

Figure 11:
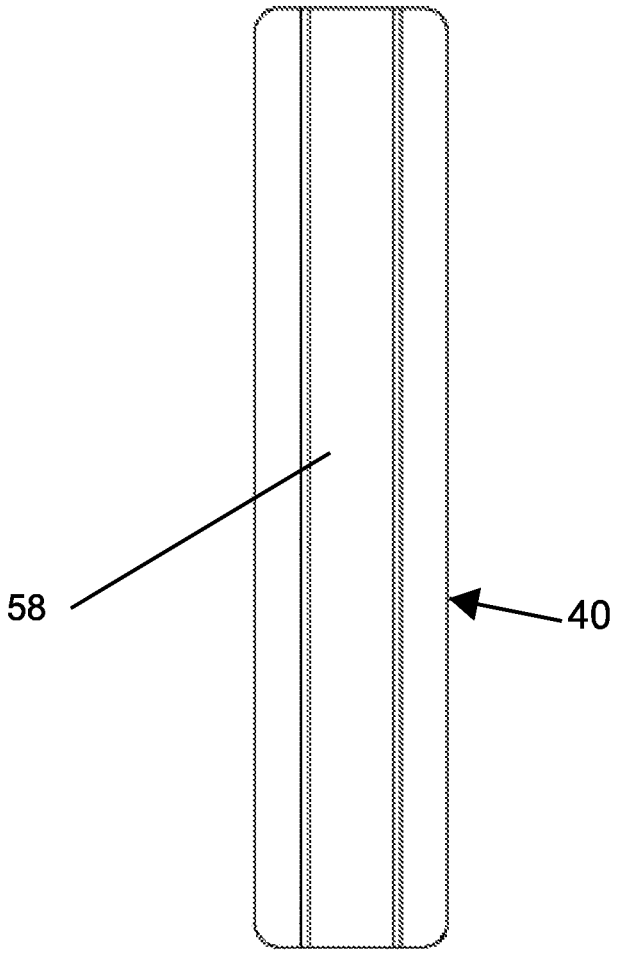
FIG. 11 is a top view of the straight handle.
Figure 11A:
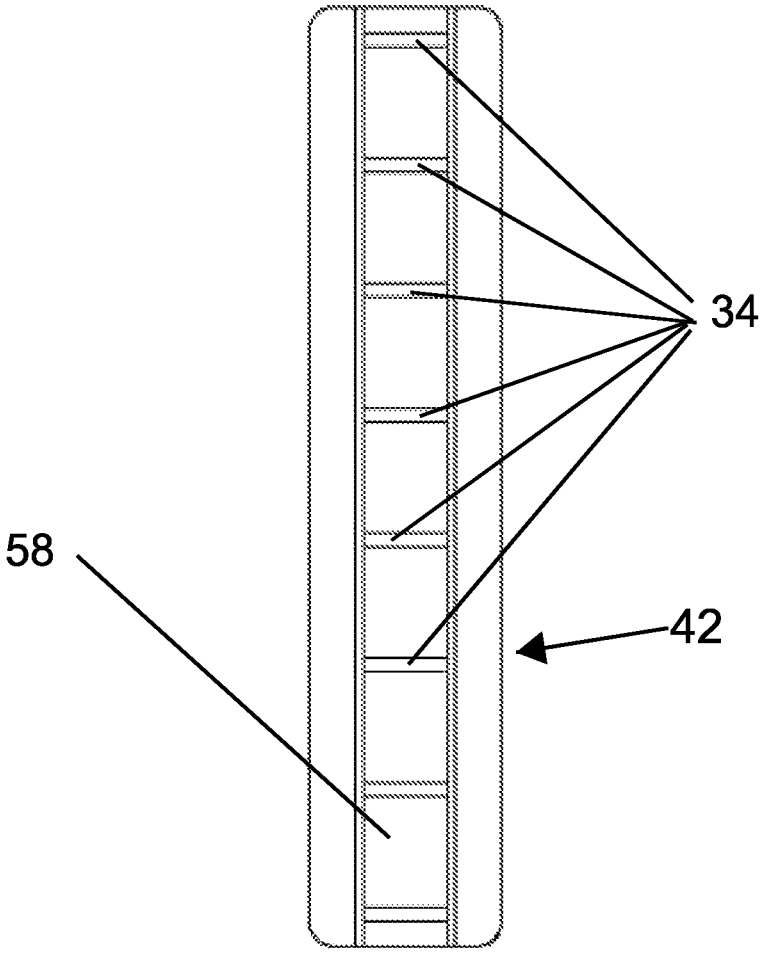
FIG. 11A is a top view of another embodiment of the straight handle.

FIGS. 11 and 11A shows a top view of two different embodiments of the straight handle 40. In FIGS. 11 and 11A one sees that the straight handle 42 has a dove tail groove 58 at op.

Figures 13, 13A:
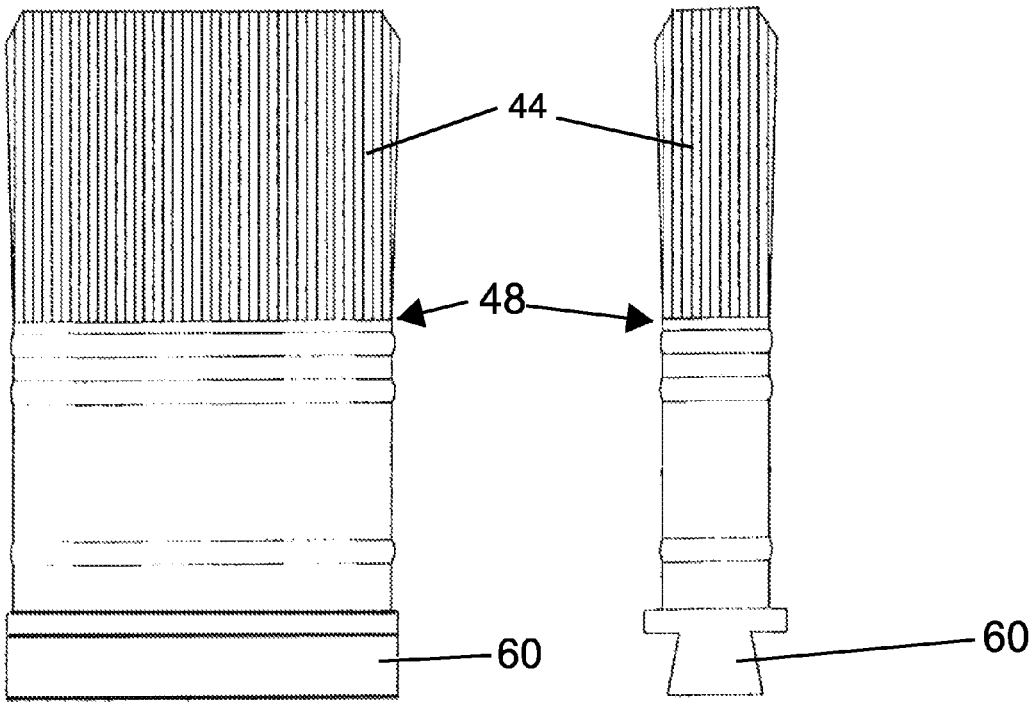
FIG. 13 is a side view of the brush head 48.
FIG. 13A is an end view of the brush head 48.

FIG. 13 is a side view of the brush head 48. FIG. 13A is an end view of the brush head 48. The end view FIG. 13A shows that the bottom of the brush head 48 has a dove tail extension 60. This dove tail extension 60 fits within the dove tail groove 58 at the top of the straight handle 42 show in FIG. 11. Dovetail extension 60 and dovetail groove 58 are designed to fit together with a friction fit. Dovetail extension 60 and dovetail groove 58 are designed with a friction fit so that the brush head 48 will not move on straight handle 42 without substantial force. In the preferred embodiment the straight handle 42 and the dovetail extension 60 of brush head 48 are made of plastic. The plastic is picked from a group of plastics that create a secure friction fit.

Figures 13B, 13C:
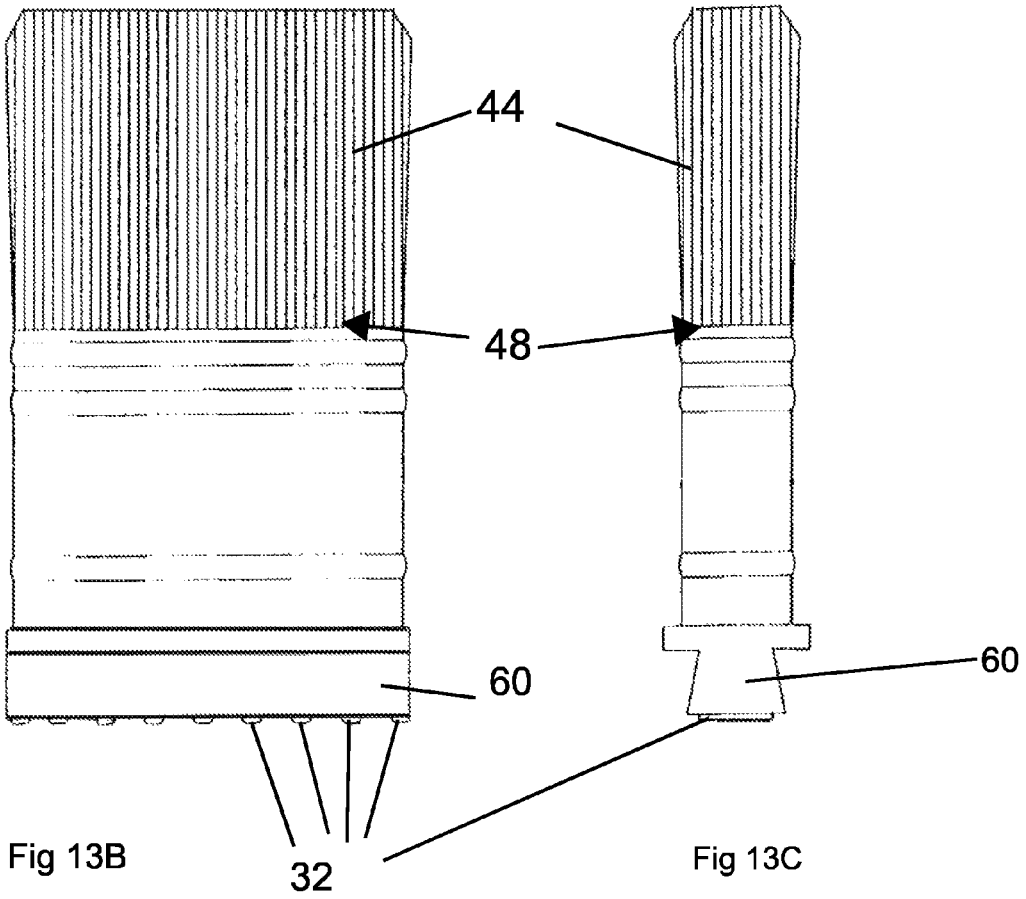
FIG. 13B is a side view of another embodiment of the brush head 48.
FIG. 13C is an end view of another embodiment of the brush head 48.

Another embodiment of the invention is the straight handle 42 shown in FIG. 11A and the brush head 48 are shown in FIGS. 13B and 13C. In this embodiment straight handle 42 and brush head 48 are made exactly as the previous embodiment except that on the dovetail extension 60 on brush head 48 a set of bumps 32 are placed. These bumps 32 correspond to a set of grooves 34 placed on the bottom of the dove tail groove 58 of straight handle 42 shown in FIG. 11A. When the dovetail extension 60 is placed within dovetail groove 58 the bumps 32 on the dovetail extension 60 fit within the grooves 34 on the dovetail groove 58.

Figure 14:
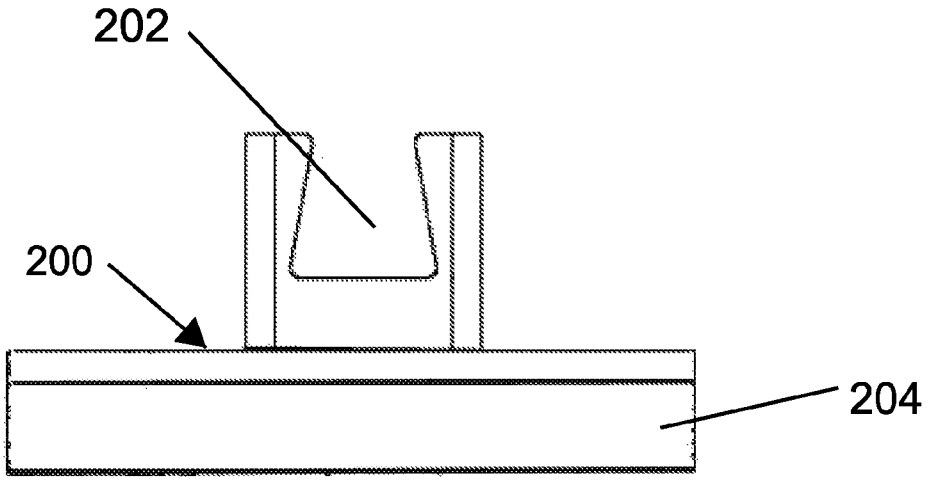
FIG. 14 is a front view of device 200.
Figure 14A:
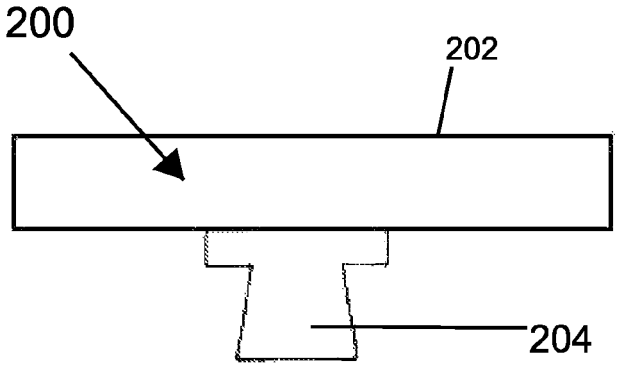
FIG. 14A is a side view of device 200.

FIGS. 14 and 14A show a device 200 that can be attached to perpendicular handle 10 or straight handle 42. The device 200 is an attachment to perpendicular handle 10 and straight handle 42 that enables the brush heads 18 and 48 or the attachment rollers 100 to be attached to the perpendicular handle 10 and the straight handle 42 at a 90° angle. Device 200 comprises a dovetail groove 202 attached to a dove tail extension 204. The dovetail groove 202 is perpendicular to the dovetail extension 204. The dovetail extension 204 is designed to fit within the dovetail groove 28 of the perpendicular handle 10 and the dovetail groove 58 of the straight handle 42. When device 200 is placed on either the perpendicular handle 10 or the straight handle a brush head 18 or 48 or an attachment roller 100 can be placed within the dovetail groove 202 and will be oriented perpendicular to the straight handle 42 and the perpendicular handle 10.

I claim:

1. A paint roller attachment comprising:

a. a cylindrical cage on which a cylindrical painting surface is place; and, b. a cylindrical bar axle that is axially attached to the cylindrical cage and passing through the center of the cylindrical cage; and, c. the cylindrical bar axle upon exiting the cage bends downward; and, d. the cylindrical bar axle then bend back parallel to the cylindrical cage; and e. an attaching section that attaches at one end to the cylindrical bar axle at a right angle and is located below the cylindrical cage and extends perpendicularly from the cage and in position on a center line with the cage f. the attaching section is comprised of;

1) an elongated block with two ends, an attaching end and a distal end, and the attaching end attaches to the cylindrical bar axle; and, 2) a dove tail extension that extends from a side of the elongated block, g. a handle attached to the attaching section comprising:

1) a handle attaching section with a top that has a dove tail groove that will fit over the dove tail extension of the attaching section, and 2) a grasping section that is attached to the handle attaching section that is offset and parallel to the handle attaching section leaving an open area between the grasping section and the handle attaching section such that the grasping section can be grasps.

2. A paint roller attachment as in claim 1 further comprising:

a. a threaded extension attached to the distal end of the attaching section; and, b. said threaded extension is a cylindrical tube with threads on the inner wall; and, c. the threaded extension allows a pole with a threaded end to be screwed to the attaching section.

3. An attachment for painting comprising:

a. a dove tail groove section with a bottom and a center whose top has a dove tail groove; and, b. a dove tail extension section with a top and a center and a dove tail extension extending from its bottom; and, c. the bottom of the dove tail groove section is attached to the top of the dove tail extension section at a perpendicular angle and in approximately the center of the both the dove tail extension and the dove tail groove sections such that the dove tail groove extends from the top of the attachment and the dove tail extension extends from the bottom of the attachment and the plane of the dove tail groove is perpendicular to the plane of the dove tail extension.

4. An attachment for painting as in claim 3 further comprising:

a. a handle attached to the dove tail extension section.

5. An attachment for painting as in claim 4 wherein:

a. the handle comprises:

(1) a dove tail groove section whose top has a dove tail groove that will fit over the dove tail extension; and, (2) a grasping section that is attached to a dove tail groove section that is offset and parallel to the dove tail extension section leaving an open area between the grasping section and the attaching section such that the grasping section can be grasps.

6. An attachment for painting as in claim 4 wherein:

a. the handle is designed to be removed and reattached attached to the dove tail extension section.

7. An attachment for painting as in claim 6 wherein:

a. the handle comprises:

(1) a dove tail groove section whose top has a dove tail groove that will fit over the dove tail extension; and, (2) a grasping section that is attached to a dove tail groove section that is offset and parallel to the dove tail extension section leaving an open area between the grasping section and the attaching section such that the grasping section can be grasps.

* * * * *